US008893984B2

(12) United States Patent
Sands et al.

(10) Patent No.: US 8,893,984 B2
(45) Date of Patent: Nov. 25, 2014

(54) MISTING BOTTLE WITH FAN

(76) Inventors: Michael Sands, Phoenix, AZ (US); Michael Davis, Santa Monica, CA (US)

( * ) Notice: Subject to any disclaimer, the term of this patent is extended or adjusted under 35 U.S.C. 154(b) by 254 days.

(21) Appl. No.: 13/549,526

(22) Filed: Jul. 16, 2012

(65) Prior Publication Data

US 2014/0014740 A1 Jan. 16, 2014

(51) Int. Cl.

| | |
|---|---|
| ***B05B 3/02*** | (2006.01) |
| ***B05B 11/00*** | (2006.01) |
| ***B05B 9/04*** | (2006.01) |
| ***B05B 9/08*** | (2006.01) |
| ***F24F 3/14*** | (2006.01) |

(52) U.S. Cl.
USPC ..... 239/289; 239/288; 239/288.5; 239/332; 239/333; 261/89; 261/90

(58) Field of Classification Search
USPC ..... 239/152, 154, 215, 222.11, 288–288.5, 239/289, 329, 332, 333; 261/28, 89, 90; 222/175, 333, 383.1
See application file for complete search history.

(56) References Cited

U.S. PATENT DOCUMENTS

| | | | | |
|---|---|---|---|---|
| 3,997,115 | A * | 12/1976 | Licudine | 239/351 |
| 5,338,495 | A | 8/1994 | Steiner et al. | |
| 5,478,015 | A | 12/1995 | Black | |
| 5,620,633 | A * | 4/1997 | Junkel et al. | 261/28 |
| 5,622,056 | A | 4/1997 | Utter | |
| 5,667,731 | A | 9/1997 | Junkel et al. | |
| 5,667,732 | A | 9/1997 | Lederer | |
| 5,715,999 | A * | 2/1998 | Hsu | 239/29 |
| 5,752,662 | A * | 5/1998 | Hsu | 239/215 |
| 5,775,590 | A | 7/1998 | Utter | |
| 5,834,344 | A * | 11/1998 | Cheng | 438/158 |
| 5,965,067 | A | 10/1999 | Junkel et al. | |
| 6,161,777 | A * | 12/2000 | Carter et al. | 239/222.11 |
| 6,371,388 | B2 | 4/2002 | Utter et al. | |
| 6,378,845 | B1 * | 4/2002 | Hsu | 261/28 |
| 6,398,132 | B1 | 6/2002 | Junkel et al. | |
| D503,212 | S | 3/2005 | Peloquin | |
| D507,642 | S | 7/2005 | Radtke et al. | |
| D512,482 | S | 12/2005 | Utter et al. | |
| 7,143,958 | B1 * | 12/2006 | Dorney | 239/289 |
| D553,227 | S * | 10/2007 | Chen | D23/328 |
| 7,566,048 | B1 * | 7/2009 | Ptak | 261/28 |
| 7,806,388 | B2 * | 10/2010 | Junkel et al. | 261/28 |
| 2005/0045742 | A1 | 3/2005 | Nakamura | |
| 2007/0210122 | A1 | 9/2007 | Giovannoni | |
| 2008/0169575 | A1 * | 7/2008 | Chen et al. | 261/28 |
| 2008/0237899 | A1 * | 10/2008 | Chen | 261/28 |
| 2010/0264235 | A1 | 10/2010 | Mak et al. | |
| 2011/0101128 | A1 | 5/2011 | Huang | |

* cited by examiner

*Primary Examiner* — Darren W Gorman
(74) *Attorney, Agent, or Firm* — Law Office of Ken Dallara; Ken Dallara

(57) ABSTRACT

An improved misting bottle and fan apparatus capable of both convective cooling and evaporative cooling independent of either other. The operator can select to have the convective cooling effects of air being blown over the operator. The operator can select to have the evaporative cooling effects of pressurized fluid forced through a small orifice showered down at the operator. In the alternative, the operator is able to select both style of cooling using this device. The positioning and shape of the atomizing device in relation to the forced air is unique as well as the shaping of the air flow optimizes the cooling effects. Location of the atomizing device is proscribed as to prevent the occurrence of drips and runs commonly associated with misting fans.

12 Claims, 6 Drawing Sheets

SECTION B-B

DETAIL B'

B
B'
101
102
103
104
106
108
109
109b
109f
110
111
115
116
117
118
119
119s
120
121
122
124
125
126
130
131
132
133
134
135
136
201
202
205
206
250
252
253

DETAIL C

MISTING BOTTLE WITH FAN

SUMMARY OF THE INVENTION

This invention is generally related to the field of personal misting devices whereby an individual will use this device to cool themselves or others in close proximity. The device works by a combination of convective and evaporative cooling principles. Though this device is hand-held, the principles disclosed and herein used can serve as a basis for larger applications.

BACKGROUND OF THE INVENTION

There are a multitude of different personal cooling devices. They generally fall into three classifications; 1) those devices that supply a mist of fluid, 2) those devices with only a fan and 3) those that have misting capabilities with some form of fan device.

In respect to the development of those devices which supply a mist of fluid, it can easily be seen in the prior art disclosed that the concept is not unique to this invention. The vessel that is used to contain the fluid during pressurization can be in many shapes, from square (U.S. Pat. No. 5,622,056) to cylindrical (U.S. Pat. No. 5,775,590) to product shaped (U.S. Des Pat. D439966) and the pressurization method can either come from a pump, manually driven (U.S. Pat. No. 6,371,388) or motor driven (U.S. Pat. No. 8,016,270), that pressurizes the fluid or that inflates a bladder (U.S. Pat. No. 5,622,056), that when pressurized or inflated thereby increases the volume of air in the vessel, thereby creating pressure according to Boyle's Law. Due to this pressure, when the fluid is released to the atmosphere, through a restrictive throttling where it is atomized, heat is extracted heat but not exchanged. This process is also known as the Joule-Thompson effect or evaporative cooling. It is obvious that motor driven pumps are either subject to increased weight for pump mechanism and power sources or failure of power when the device is most needed.

Personal fans have been disclosed in many different shapes but all have a basic design whereby fan blades are attached to a central hub and air is exhausted therethrough. The purpose is primarily cooling through the evaporation of moisture on one's skin through an adiabatic process. (U.S. Pat. Nos. 6,155,782 and 5,667,732)

It has also been disclosed by prior art that fans have been used to disperse the air that has been cooled through evaporative cooling. This convective cooling principle works where air, that has been cooled through evaporative cooling now flows over surfaces of greater heat, thereby cooling those surfaces. The rate of heat loss of a body is proportional to the difference in temperatures between the body and its surrounding as by Newton. Prior art has several methods of dispersing this air cooled through evaporative cooling. U.S. Pat. No. 2,079,117 details fluid being dispensed from a centralized hub along the blades of the fan. The problem with this approach is that the fluid will coalesce along the blades as the is the air pressure over the blades is much higher than the air immediately in front of the blade, causing a vacuum effect, very similar to the concept that propels sailboats going upwind. Mist will form up along the edges of the blades and will whip off circumferentially negating the cooling effects of the fluid. Other disclosures have the fluid emanate from behind the fan structure (U.S. Pat. No. 4,338,495)) or where the misting device is placed in front of the fan at varying distances away from the actual fan itself (U.S. Pat. No. 8,016,270 and U.S. Pat. No. 6,371,388). Both devices suffer from a deficient design that does not optimal utilize the cooling effect. Being behind the blade causes the blade to intersect the fluid stream causing drips and those devices that place the misting device in front of the fan suffer from the centripetal forces caused by the rotation of the air about the center of the fan hub. The main stream of the fluid flow from the fan rotates about the central axis of the fan whereby the fluid streams "rifle" away from the fan. This "rifling" of heavy moisture laden air causes the mist to be concentrated into a narrow beam of cooling.

What is needed then is a device which has the ability to produce a cooling effect upon people through the use of evaporative and convectional cooling which does not have any of the negative attributes of the prior art.

What is needed is a device that combines the best attributes of convective cooling and the best attributes of evaporative cooling effect while eliminating the problems associated with the prior examples of the art and then let the operator choose the desired effect.

DESCRIPTION OF THE INVENTION

The device herein disclosed is an optimized fan and misting device where the air flow is channeled through a specially designed shroud having a reverse rake angle and smoothed air flow lines which reduces the turbulent flow which reduces the cooling effects of the air. This design also introduces atomized water above and in front of the fan blades reducing drips and take advantages of the spiraling laminar flow.

DESCRIPTION OF THE DRAWINGS

The following description and the figures to which they refer are provided for the purpose of describing examples and select embodiments of the invention only and are not intended to exhaustively describe all possible examples and embodiments of the invention. Many specific implementations of the following described system will be apparent to those skilled in the art.

It is understood that in this detailed description of the drawings that all devices will be presented in the singular form. The singular form is used generically to imply either a singular device or a plurality of similar devices can be used in the described situation, meaning, for example, that when a fluid flow release button is described, the scope of this invention covers a button or buttons.

Figure 1:
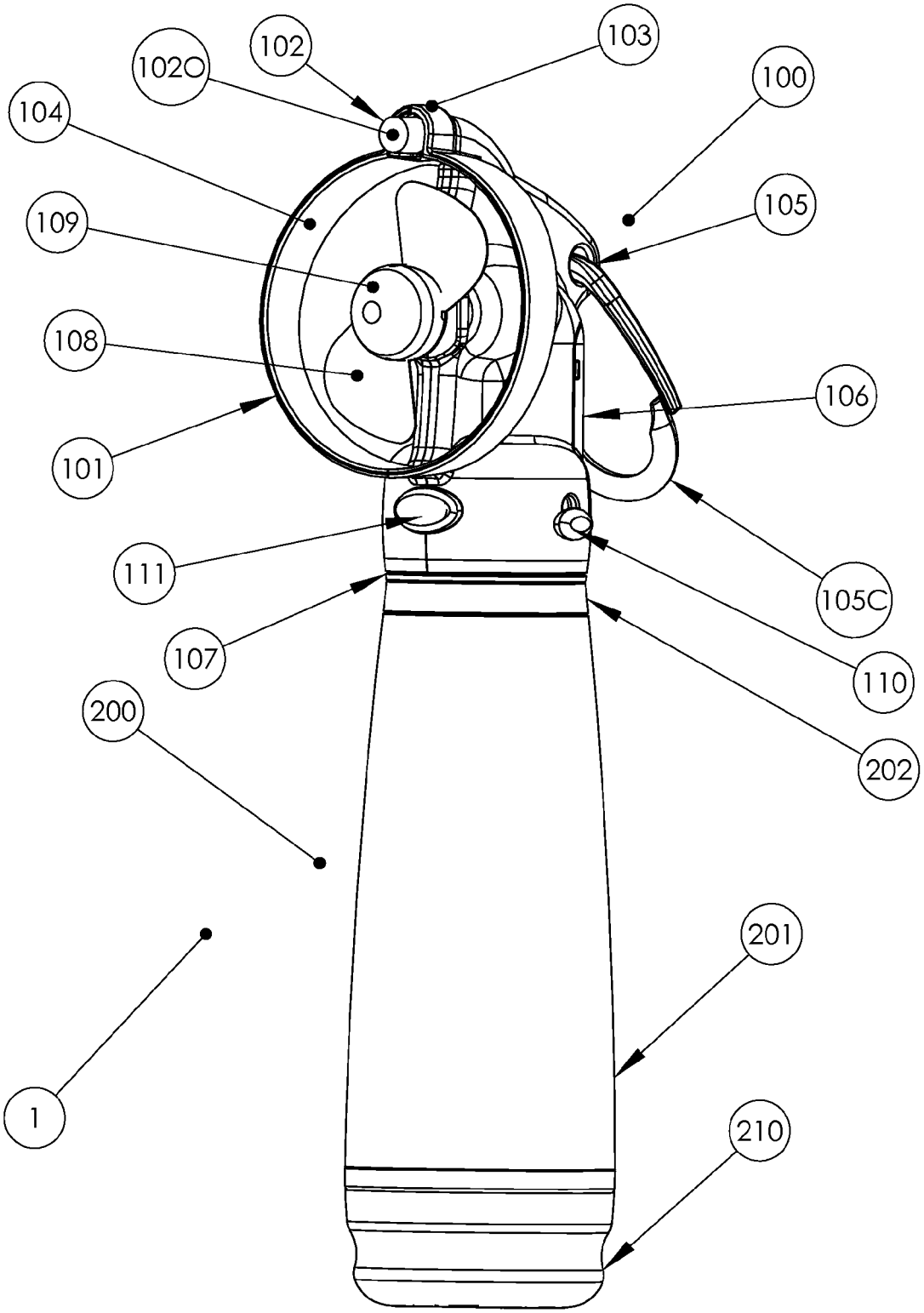
FIG. 1 details a frontal oblique view of the device possessing the optional carabineer as a means for attaching the device to a person.
Figure 2:
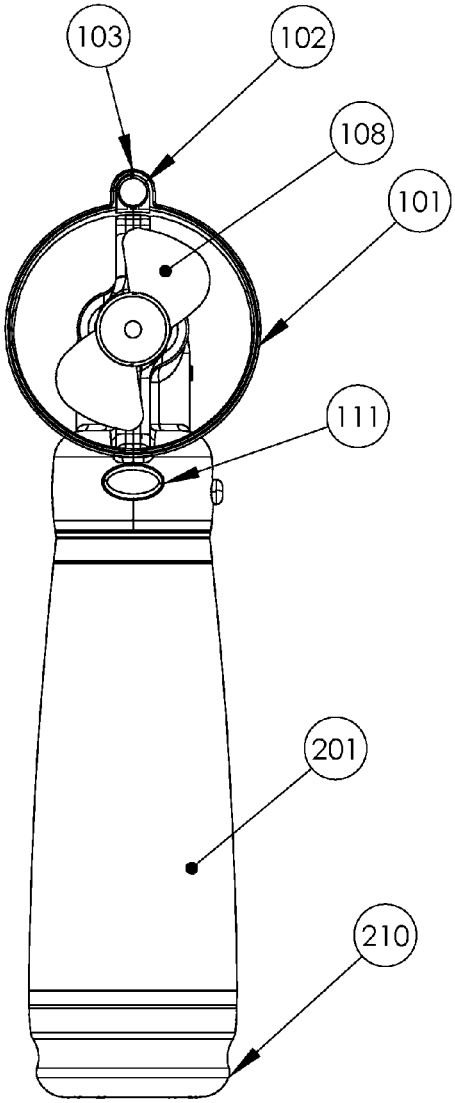
FIG. 2 is a frontal view of the device.

FIG. 1 shows the frontal view of the assembled device 1. Device 1 comprises two main sections, bottle 200 and fan portion 100. In this view, bottle body 201 is shown as a opaque solid color but a translucent body can be used if desirable. Body 201 is also shown as a completely radiused body where all surfaces contain a curvature. It is foreseen that this device can be used in many different forms, including those with flat surfaces where images or words can be attached through decals or pad-printing or advertising or promotional purposes. Bottle 200 has pump portion 210 on the distal end and bottle attachment collar 202 on the proximal end of the bottle 200 which interfaces with the lower mating edge of fan portion 107.

FIG. 1 also shows the exterior views of fan portion 100 and this view contains the optional personal attachment means 105C which allows for attachment of device 1 onto another item, such as a person's belt or backpack. In this embodiment, a carabineer is used which attaches through personal attachments means slot 105 near the distal end 106 of fan portion 100.

Fan portion 100 has two main means to control the cooling functions of the device; 1) fan or convective cooling control 110 and 2) misting or evaporative cooling control 111. Fan control 110 in this embodiment is a slide switch having basic bifurcated controls. It is also conceived that this switch possess alternate designs including but not limited to 3 position switches with alternate fan speeds. Misting control 111 is a spring return momentary contact flow switch controlling the flow of fluid from the bottle portion 200 into atomizing device 102, whereby pressurized fluid emanates from orifice 102O. Atomizing device 102 is protected by atomizing shield 103 where orifice 102O is located at least perpendicular to or extends out from the outermost edge of shield 103. Misting control 111 is located for ease of use in the front of the device but is not limited thereto that particular location.

Figure 3:
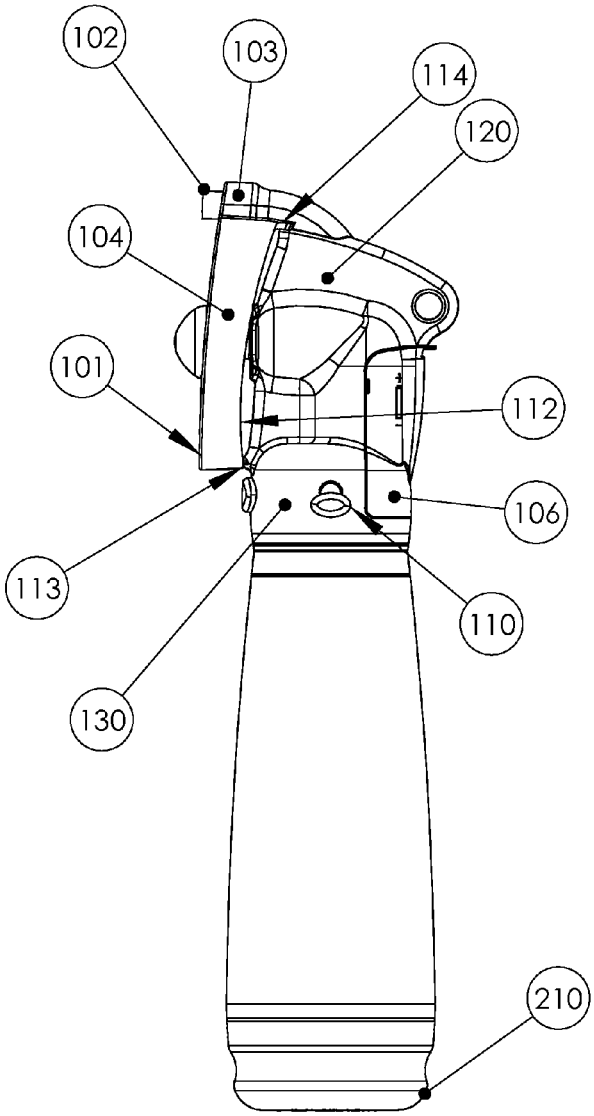
FIG. 3 is a left side view of the device showing the control buttons designed for one handed use.
Figure 4:
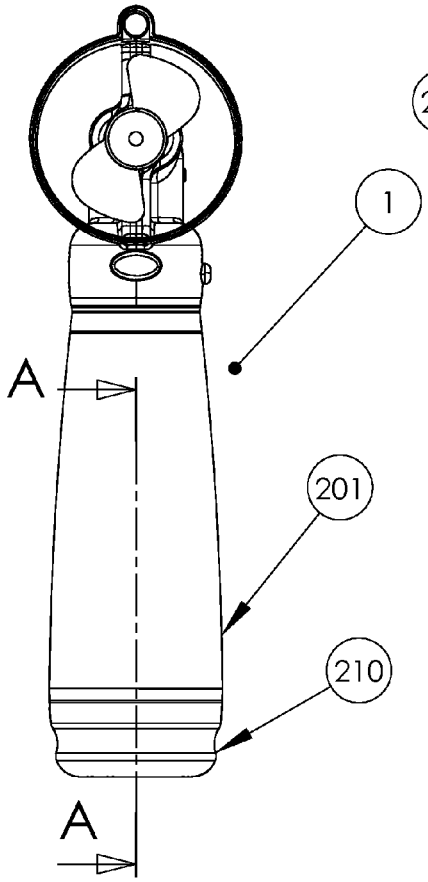
FIG. 4 is a frontal view showing the cutting route for a cross-sectional internal view of the lower bottle portion of the device.

Fan shroud 104 circumferentially surrounds fan blades 108 which are centrally attached to fan hub 109 where leading edge of fan shroud 101 has a reverse rake angle attaching to atomizing shield 103 at the highest point. Lower shroud contact point 113 connects shroud 104 to fan portion 100 while upper shroud contact area 114 is molded into fan portion upper 120 as detailed in FIG. 3. It is also detailed that the trailing edge 112 of shroud 104 has a reverse rake angle greater than that of leading edge 101, this is so as to increase the amount of surface area behind the fan facilitating more air flow that is not impinged or interrupted by the actual fan portion 100. It should be noted that all surfaces of the fan portion 100 have a curvature that directs the flow of air into the fan itself and promotes as much as possible a laminar flow thereover and enables the air stream that is propelled or accelerate outwardly to have a tighter spiraling pattern. It should also be noted and is detailed in FIG. 3 that the leading edge 101 trails rearwardly as it approaches the atomizing device 102, thereby reducing the effects of turbulence of the air flow surrounding atomizing device 102. It is found in the prior art that the location of the atomizing device in relation to the fan is critical to it's effectiveness. As aforementioned, this device has the atomizing device above and in front of the fan blades, an unique attribute that contributes to the increased cooling efficiencies of the device. The rearward sloping, or raked, shroud prevents turbulence of the air flow around the misting device 102 along with decrease the surface area upon which the atomized fluid can attach to causing drips. In this invention the atomizing device is commonly referred to as a mister, which is a device where fluid is turbulently stirred in an interior chamber prior to passing through an orifice of approximately 0.005" to 0.015" in diameter.

Figure 5:
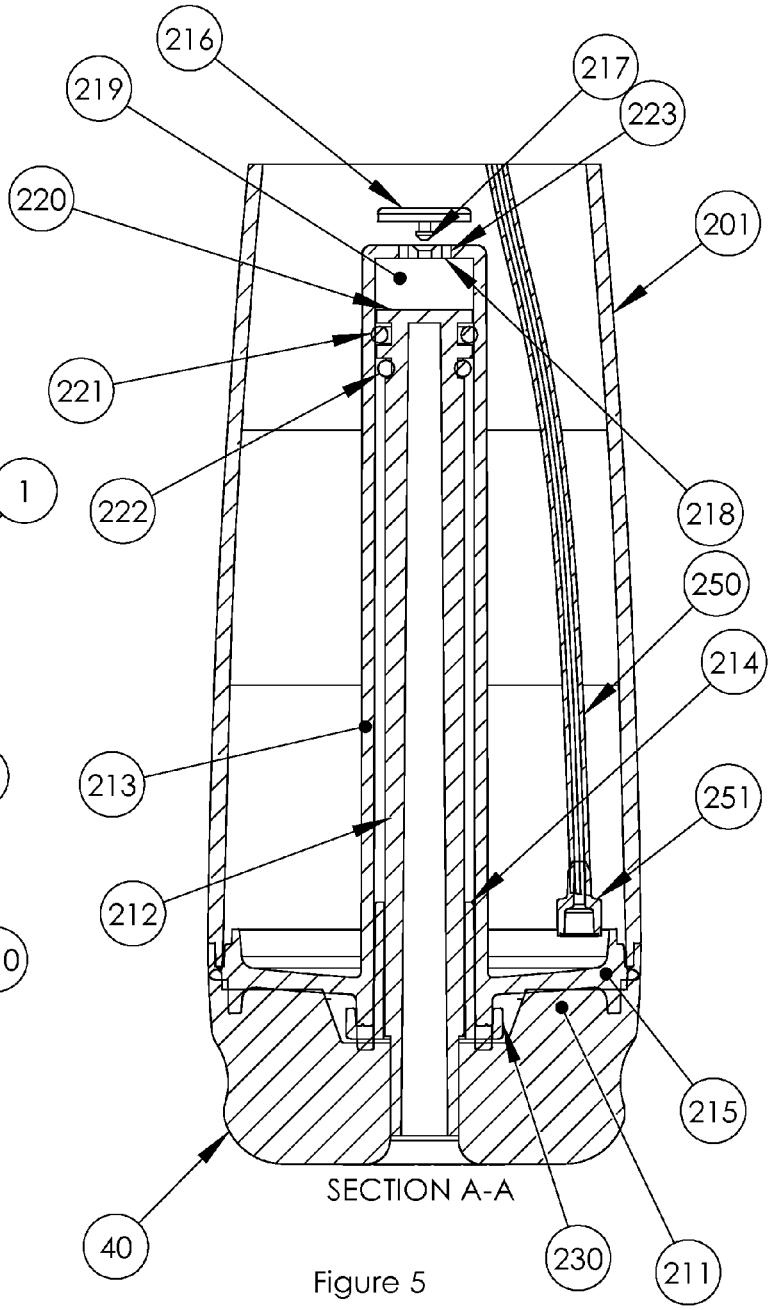
FIG. 5 is a cross-sectional view of the bottle portion of the device where pressure check valve is shown above it's normal orientation for clarity purposes.

FIG. 5 details a cross-section of the bottle portion 200. The bottle portion contains the pressure inducing means as well as the actual fluid vessel. The pressure inducing means is interiorly located within the bottle. Centrally located is pressurization chamber 219 which is contained by chamber wall 213 which emanates from bottle bottom 215. Interiorally located therein chamber 219 is plunger piston 212 which is adapted to fit tightly inside of chamber 219 and has a double o_ring seal, 221 and 222, at the distal end of plunger 212. Plunger piston 212 is fixably attached to pump portion 210. Pump portion 210 is shaped so as to adapt to the heel of the users hand and contains contour 40 which is designed to interface the fingers and palm of the user. Plunger piston 212 is restrained by plunger cap 230 located at the proximal end of bottle 201 and prevents the detachment of plunger 212 from chamber 219. Located also at the distal end of bottle 201 along with plunger 212 is plunger stop 214 which limits plunger travel. Plunger's height is the limiting factor that controls the amount of pressure generated and maintained inside bottle 201. The size of pressurization chamber is defined by the top of plunger piston 220 and the top of chamber 223. In this invention, the device is capable of handling up to 6 ATM of pressure safely. Flapper 216, shown slightly above and purposefully out of location, provides a one-way check valve during pressurization. When the plunger is forcibly pushed towards the pressurization chamber, air is forced through exit holes 218, which can vary in number to best allow for proper flow. Difference in pressure between the chamber and the interior of bottle 201, seats flapper 216 onto chamber top 223 thereby sealing the flapper. Post 217 serves to center flapper 216 over exit holes 218 as it attaches through the central exit hole 218 with a reverse barb that secures it into the hole. Fluid tube 250 serves as the means to transport fluids from the bottle 201 to the atomizing device 102 and has filter 251 attached to the distal end of tube 250 to prevent solids from entering the tube and eventually clogging the orifice 102O of atomizing device 102.

Figure 8:
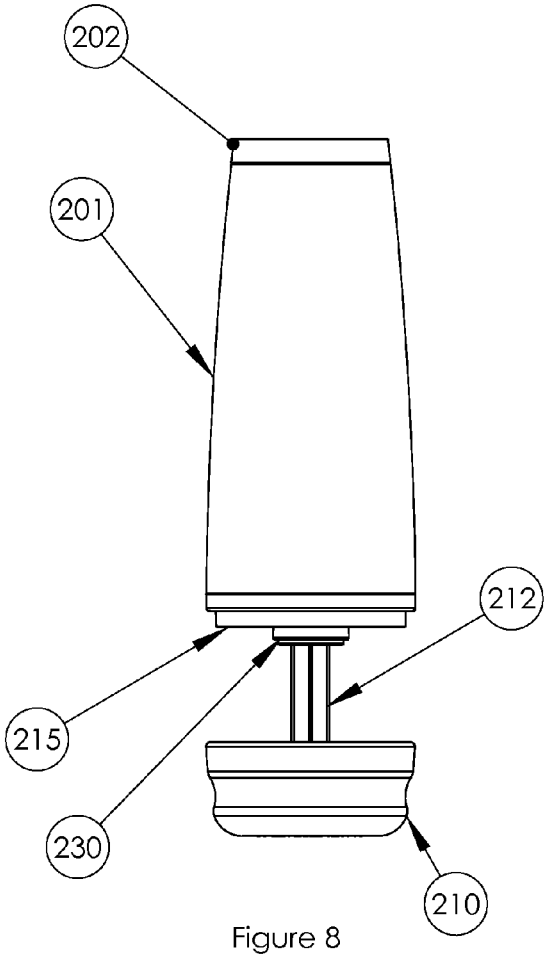
FIG. 8 is a view of solely the bottle portion of the device showing the extension of the pump handle away from the unit.
Figure 10:
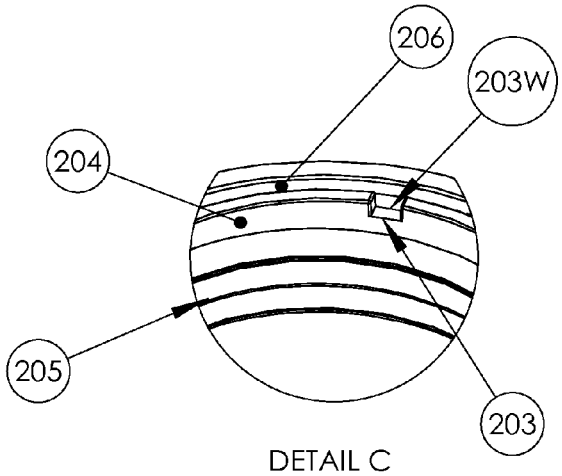
FIG. 10 shows the detail of the upper portion of the bottle detailing pressure relieving reliefs and O-Ring blowout preventers.
Figure 9:
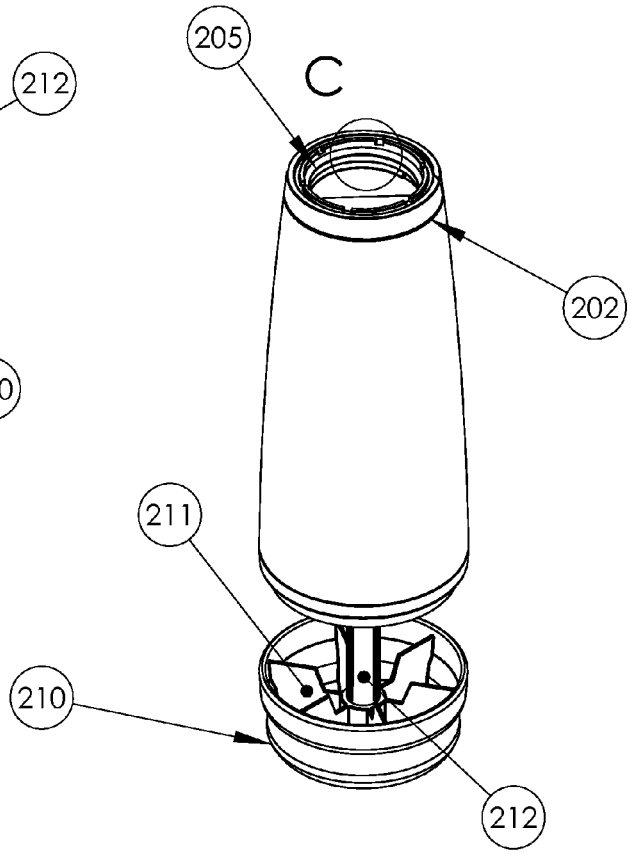
FIG. 9 is an oblique view of the bottle portion with the pump handle extended showing the interior detail of the pump handle.
Figure 11:
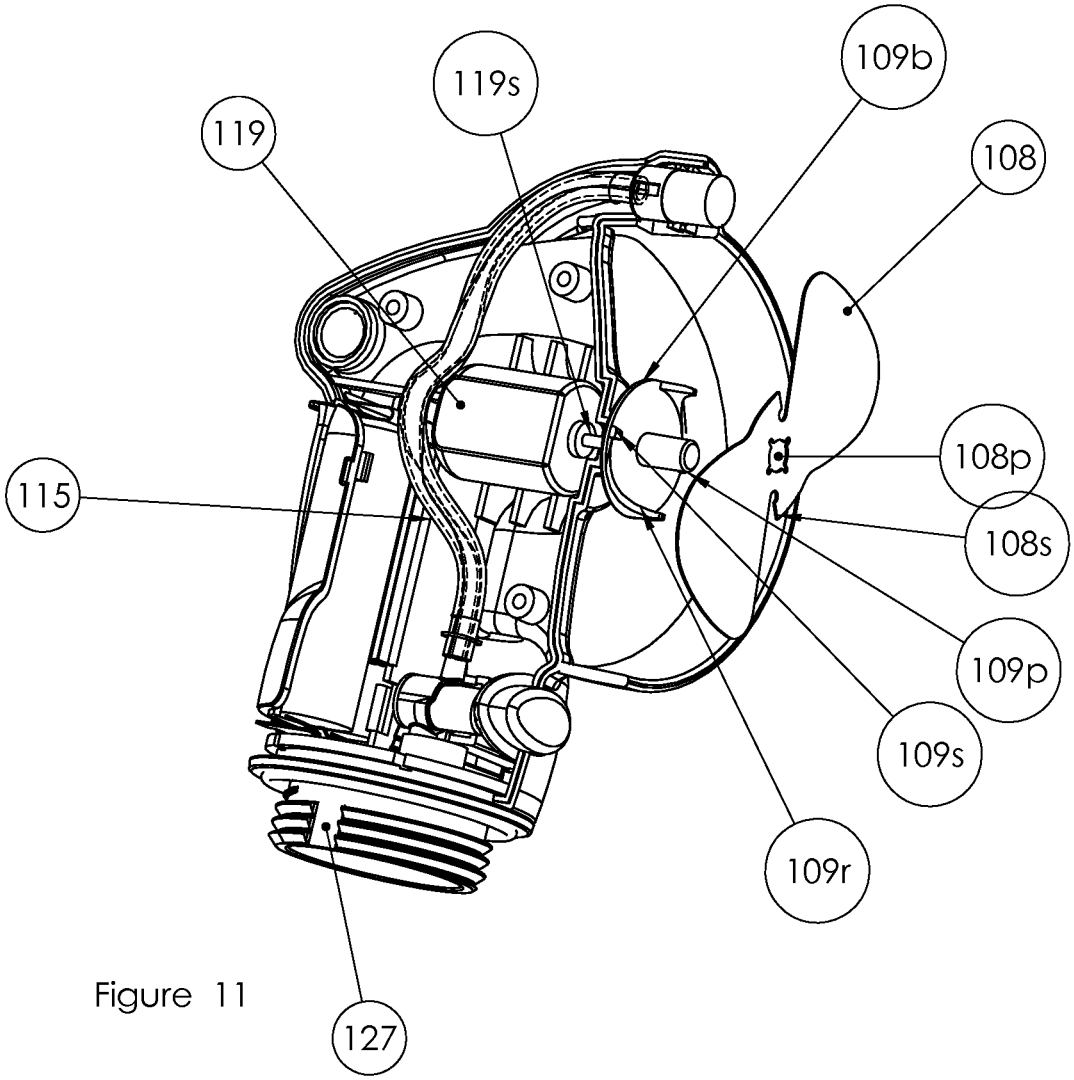
FIG. 11 is a cross-sectional detail of the fan portion of the device the front part of the fan blade hub has been removed and the fan blade has been exploded out for clarity.

At the proximal end of bottle 201, attachment collar 202 is located as seen in FIG. 8. FIG. 8 shows pump portion 210 as it is partially withdrawn. FIG. 9 details supporting fins 211 located interiorally in pump portion 210, said fins contacting the proximal portion of bottle 201 when the pump is fully engaged into pressurization chamber 219. FIG. 10 details blown-up section C from FIG. 9 which details O-Ring sealing groove 206 along with pressure relief slots and O-Ring dislodgement preventer 203, preventer 203 located on interior portion of attachment collar 202, where preventer 203 is located between threads 205 and O-Ring groove 206 where preventer 203 is in communication with groove 206. Should the bottle be disengaged from the fan portion while the bottle is under a pressure greater than the atmosphere, the user could be harmed. In the purpose of the pressure relief slots 203 is to allow for a quick controlled release of pressure through the multiple slots around the circumference of the attachment means 202 once the user has slightly disengaged the two portions, preventing complete blowout once the attachment means can not contain the pressure. The attachment means in this example are threads 205 which mate with the attachment means of the fan portion. Relief slots 203 also are shaped to contain three sides, whereby there is a wall between the relief slot and the O-ring, thereby preventing harm to the O-Ring should there be a rapid de-pressurization by the user, when disengaging the portions while under pressure. Tests showed that the O-Ring suffered damage and dislodgement without the wall 203W separating the relief slot from the O-Ring. FIG. 11 also details the presence of air relief slots 127 having vertical orientation being radially dispersed about the perimeter of the male thread, each slot approximately covering 8-12 degrees of circumference. In this invention, the male threads are located on the fan portion of the device. It is equally capable of having the male threads on the bottle portion of the device and the female threads on the fan portion. In this device 2 air relief slots were used, but the number of slots are not limited to 2, nor is there size limited to that which is disclosed. Slots 127 further relieves pressure that is built up inside of the bottle with minimal disengagement of the threads. A slight disengagement will sent pressurized air through the slots relieving the greatest amount of pressure built up in the bottle, as a safety to the operator.

Figures 6, 7, 7A:
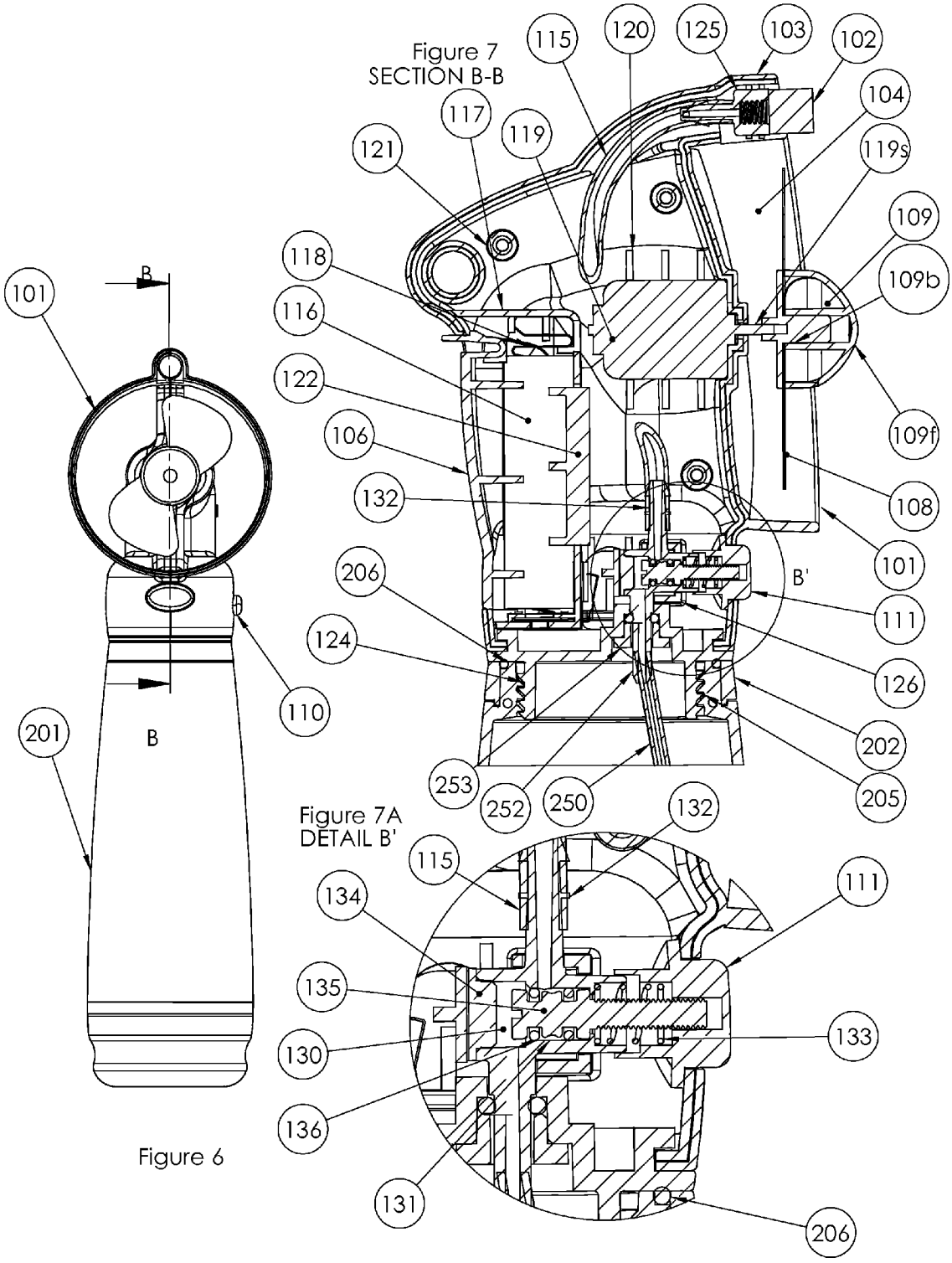
FIG. 6 is a frontal view showing the cutting route for a cross-sectional internal view of the upper portion or fan portion of the device.
FIG. 7 is a cross-sectional view of the fan portion of the bottle and FIG. 7A is a detail of the trigger mechanism that controls the flow of fluids.

FIGS. 7 and 7A are the cross-sectional detail of the fan portion 100 of device 1. Fan portion 100 contains controls for the delivery of fluid to the misting device 102 and control of fan blades 108. Fan portion is designed in two vertically split halves fastened together with fasteners 121, each half provide support to the mechanisms located therein. Fan portion 100 is attached to the bottle portion 200 through the intermeshing of bottle threads 205 and fan portion threads 124 to such an extent so that collar 202 and mating edge 107 are in forcible contact. Sealing means 206, in this case an O-Ring is used, either circular or square cut in nature, provides a fluid tight fit between the two portions. Fluid delivery from the bottle portion of the device is accomplished through fluid supply tube 250 which is attached at the proximal end to barbed inlet 252. Optional tubing collar 253 can be slipped on over the tubing prior to insertion upon inlet 252 and is slipped into place afterwards to insure a tight fit between the outside of the barbs and the inside of tube 250. Fluid exit tube 250 into reservoir 130 whereby it remains until the operator pressing misting button 111. The misting button assembly is located in this disclosure in the front of the device is the flow controlling means that regulates the flow of fluid from said bottle portion to the atomizing device 102. Nothing in this disclosure limits the location of the misting button 111 nor the operator power switch 110 to any particular location. The misting button assembly is held in place by misting button carriage 126 located on one of the two halves of the fan portion 100. The pushing of button 111 inwardly is resisted by spring 133 and is responsible for relocating flow pin 135 into the reservoir until contact with stop block 134. Located on pin 135 is flow channel 131, which when pin 135 is laterally displaced, allows fluid flow from reservoir 130 into misting tube 115 through barbed outlet 132. The amount of fluid that passes through is variably regulated by the extent that pin 135 is displaced from it's resting position until it contacts block 134. There exists seal means 136 on either side of channel 131 which prevents the escape of fluid out of reservoir 131 into the button area, preventing unsightly drips out of the button cavity and also prevents the escape of pressurized fluid into the misting device. Misting tube 115 vertically transits the fan portion from the lower sealing end to the upmost portion of mister shield 103 until engaging onto misting inlet barb 125. Misting barb 125 has an external barb onto which tube 115 is slipped onto and an interiorially located female threaded portion which is designed to accept misting device 102.

Control of the fan blades comes from two sources. One is the operator switch 110 which controls the on-off function of the fan motor 119 and the other is the power supply coming from batteries 116. Switch 110 is exterior located and can be a slide switch as is show in FIG. 1 or can be a push button style. Batteries 116 are located in a cavity 117 to the rear of the fan portion and are held in position through batteries holder 122 and battery access door 106. Battery contacts 118 electronically connect the flow of power to fan motor 119 through either a series of solid contactors or flexible wires. Fan 119 is held in place with fan motor mounts 120 and is held in location to directly connect to fan hub 109 through shaft 119*s*. FIG. 11 details the hub assembly of the fan. Hub 109 consists of two pieces, blade mount section 109*b* and front hub 109*f*. Blade mount section 109*b* has an exterior portion which accepts shift 119*s* and an interior portion which provides a contoured edge 109*r* and stop 109*s* for placement of the blade. Blade mount section 109*b* contains post 109*p* which accepts the blade centering hole 108*p*. Blade 108 is a continuous blade which is made of a flexible polymer material stamped or molded into any particular shape desired. Blade 108 has a centering hole 108*p* in this case has piloting ridges along the circumference of the centering hole 108*p* as an assembly aid. The contour of blade 108 also contains a cutout 108*s* which will interface with hub stop 109*s*, holding the blade securely in place by centripetal force during use. Slope 109*s* has a matching slope located upon hub front 109*f* (not shown) which sandwiches the blade between the two halves shaping the blade into a particular contour. It is noted that in this invention the blades are contoured to obtain maximum acceleration of the air through the shroud, where the shroud, due to it's shape and angle, is able accelerate the air in a spiraling pattern. This spiraling pattern is more able to integrate the fluid from the mist and propel it forward then devices in the prior art.

It will be appreciated by those skilled in the art, that the invention is herein described with reference to certain examples or preferred embodiments as shown in the drawings. Various additions, deletions, changes and alterations may be made to the above-described embodiments and examples without departing from the intended spirit and scope of this invention which is to provide a single unitized structure or assembly that enables the convenient implementation of evaporative and convective cooling in a personal cooling device. Accordingly, it is intended that all such additions, deletions, changes and alterations be included within the scope of the following claims.

What is claimed is:

1. An improved misting bottle and fan apparatus comprising;

a bottle section, said bottle section containing a vessel capable of holding fluid and being able to withstand pressure of up to 6 ATM and a manual pressure inducing means interiorly located within said vessel, said pressure inducing means having a maximum pressure calibration and said bottle section having proximally located an attachment means; and, a fan portion, said fan portion having means to accelerate the air through the apparatus, a fan shroud, said shroud being optimally angled to direct and spiral said accelerated air, coupling means to interconnect said fan portion to said bottle attachment means, and an atomization device, said atomization device being capable of atomizing said fluid from said vessel through an orifice, said orifice being congruent to an outermost face of said atomizing device, said atomization device coupled to flow regulating means to control the amount of fluid atomized, said atomizing device is further sheltered by a shield, said shield being incorporated into said fan shroud at said shroud's highest point and said orifice is at least perpendicular to or extends out from an outermost edge of said shield; and, a control system that separates the means to accelerate the air from the means to control the flow of fluid into the atomization device so that the two said means can function autonomously; and, a piping system which is capable of transferring said fluid from said vessel to said atomization device in communication with said flow regulating means; and, an electrical connection between said means to accelerate the air and said control system that contains the means to accelerate the air.

2. An improved misting bottle and fan apparatus of claim 1 where said coupling means are a set of interrelated threads having a female threads interrelated to male threads, wherein said male threads have radially dispersed thereabout the perimeter of said thread vertically oriented air relief slots extending the entire height of said male threads.

3. An improved misting bottle and fan apparatus of claim 1 where said air accelerating means is a centralized motorized hub with flexible blades emanating therefrom, said blades having a trailing edge, collecting air prior to acceleration due to the curvature of the blades and a leading edge, said blades being constructed of a single piece of flexible material.

4. An improved misting bottle and fan apparatus of claim 1 where said atomizing device is threadably connected to said piping system.

5. An improved misting bottle and fan apparatus of claim 4 where said orifice of said atomizing device is located above said shroud.

6. An improved misting bottle and fan apparatus of claim 4 where said orifice of said atomizing device is located anteriorly to a leading edge of said shroud.

7. An improved misting bottle and fan apparatus of claim 3 where said motorized hub is powered electrically from a source located interiorly of said fan portion and where said control system that contains the means to accelerate the air, said electrical power source and said hub are connected by wires.

8. An improved misting bottle and fan apparatus of claim 7 where said electrical power source is at least one dry cell battery.

9. An improved misting bottle and fan apparatus as of claim 1 where said control system that contains separate means to accelerate the air from the means to control the flow of fluid into the atomization device so that the two said means function autonomously is located such that the user can operate both said separate and autonomous means with the same hand.

10. An improved misting bottle and fan apparatus of claim 1 where said shroud is rearward sloping and said shroud has a curved leading edge with a reverse rake and a curved trailing edge with a reverse rake greater than said reverse rake of said leading edge, where said curved leading edge trails rearwardly, increasing in depth, as it approaches said shield.

11. An improved misting bottle and fan apparatus of claim 1 where said pressure inducing means consists of a compression chamber and piston, whereby pressure is calibrated by stroke length of said piston, maximizing pressure when the pressure inside of said compression chamber and the pressure inside of said vessel is equal.

12. An improved misting bottle and fan apparatus of claim 1 where said bottle section attachment means contains multiple pressure relief slots to progressively release internal pressure in said bottle during initial disengagement of said coupling means where there is a pressure differential between said bottle section and ambient atmosphere and an O-Ring dislodgement prevention means to prevent dislodgement of an O-Ring during initial disengagement of said coupling means due to a potentially large pressure differential.

* * * * *